United States Patent [19]

Cardis

[11] Patent Number: 4,900,460

[45] Date of Patent: Feb. 13, 1990

[54] SULFURIZED OLEFIN ADDUCTS OF DIHYDROCARBYL PHOSPHATES AND PHOSPHITES AND LUBRICANT COMPOSITIONS CONTAINING SAME

[75] Inventor: Angeline B. Cardis, Florence, N.J.

[73] Assignee: Mobil Oil Corp., New York, N.Y.

[21] Appl. No.: 317,329

[22] Filed: Mar. 1, 1989

Related U.S. Application Data

[63] Continuation-in-part of Ser. No. 228,815, Aug. 2, 1988, abandoned, which is a continuation of Ser. No. 105,988, Oct. 6, 1987, abandoned, which is a continuation of Ser. No. 796,131, Nov. 8, 1985, abandoned.

[51] Int. Cl.[4] ..... C10M 135/02

[52] U.S. Cl. ..... 252/46.6; 558/40; 558/104; 252/400.21

[58] Field of Search ..... 252/46.6, 400.21; 558/40, 104

[56] References Cited

U.S. PATENT DOCUMENTS

| | | | |
|---|---|---|---|
| 2,995,569 | 8/1961 | Hamilton et al. | 252/45 |
| 3,471,404 | 10/1969 | Myers | 252/45 |
| 3,697,499 | 10/1972 | Meyers | 252/48.8 |
| 3,703,504 | 11/1972 | Horodysky | 250/45 |
| 4,152,275 | 5/1979 | Horodysky et al. | 252/46.6 |
| 4,207,195 | 6/1980 | Horodysky | 252/46.6 |
| 4,344,854 | 8/1982 | Davis et al. | 252/45 |

*Primary Examiner*—Jacqueline V. Howard

*Attorney, Agent, or Firm*—Alexander J. McKillop; Charles J. Speciale; Robert B. Furr, Jr.

[57] ABSTRACT

Sulfurized olefins having no detectable reactive olefinic bonds, particularly sulfurized isobutylene, are reacted with dihydrocarbyl phosphates or phosphites. The resulting product is useful as an extreme pressure and wear additive for lube oil compositions.

24 Claims, No Drawings

SULFURIZED OLEFIN ADDUCTS OF DIHYDROCARBYL PHOSPHATES AND PHOSPHITES AND LUBRICANT COMPOSITIONS CONTAINING SAME

RELATED APPLICATIONS

This is a continuation-in-part of copending application Ser. No. 228,815 filed Aug. 2, 1988, now abandoned which was a continuation of application Ser. No. 105,988, filed Oct. 6, 1987, abandoned, which was a continuation of application Ser. No. 796,131 filed Nov. 8, 1985, abandoned.

BACKGROUND OF THE INVENTION

1. Field of the Invention

The invention relates to novel compounds, particularly to those comprising reaction products of dihydrocarbyl phosphates and phosphites and a particular sulfurized olefin, and to lubricant compositions containing same.

2. Discussion of the Prior Art

Organic sulfur copounds have been known as additives for lubricating oils. They are generally used to provide extreme pressure properties to lubricants, especially under high-speed shock conditions. For example, sulfurized olefins are a known class of such organic sulfur compounds. Their utility and methods of preparation are disclosed in U.S. Pat. Nos. 3,471,404, 3,697,499 and 3,703,504.

Certain phosphorus compounds are also known lubricant additives. The art also shows the addition of olefins to hydrogen phosphites under the influence of a catalyst. U.S. Pat. No. 4,207,195 discloses the catalyzed reaction products of sulfurized olefins and dihydrocarbyl phosphites and their use in lubricant compositions. The reaction products are formed in the presence of an appropriate free-radical or peroxide type catalyst or azo-initiator. U.S. Pat. No. 4,207,195 is incorporated herein by reference.

SUMMARY OF THE INVENTION

The invention provides a product of reaction between a sulfurized olefin having no remaining olefinic bonds, and a dihydrocarbyl phosphate of the general formula

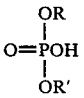

or dihydrocarbyl phosphite of the general formula

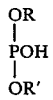

wherein R and R′ are hydrocarbyl groups and are the same or different with each having 1 to 30 carbon atoms. Thus, R and R′ may each be alkyl of 1 to about 30 carbon atoms, or aryl, alkaryl or aralkyl of 6 to about 30 carbon atoms. Thus, phosphates or phosphites wherein R and R′ include methyl, ethyl, n-propyl, isopropyl, n-butyl, isobutyl, pentyl, amyl, hexyl, ethylhexyl, oleyl, phenyl, naphthyl and the like, and mixtures thereof may be reacted with a sulfurized olefin. The sulfurized olefin is a special sulfurized olefin mixture made by the process disclosed in pending application Ser. No. 721,251, filed Apr. 8, 1985, which is incorporated herein by reference. Sulfurized olefins made by the process disclosed in application Ser. No. 721,251 are not known to have reactive olefinic sites but are regarded as having no olefinic bonds.

The invention also provides lubricant and liquid fuel compositions containing such products.

DESCRIPTION OF SPECIFIC EMBODIMENTS

As stated hereinabove, the dihydrocarbyl phosphates and phosphites useful in the practice of this invention have the formulas

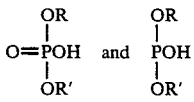

wherein R and R′ are hydrocarbyl groups and are the same or different, with each having from 1 to 30 carbon atoms. The R and R′ may each be alkyl of 1 to about 30 carbon atoms, aryl, alkaryl or aralkyl of 1 to about 30 carbon atoms. Preferably, the hydrocarbyl groups are alkyl groups.

Generally it is preferred to use the sulfurized olefins prepared as disclosed in the U.S. patent application Ser. No. 721,251, filed Apr. 8, 1985.

In accordance with the disclosure in the '251 application, a wide variety of olefinic substances can be utilized for sulfurization. This includes olefins with terminal or internal double bonds and containing from about 2 to 8 or more carbon atoms per molecule in either straight, branched chain or cyclic compounds and these may be exemplified by ethylene, propylene, 1-butene, cis and trans-2-butene, isobutylene, diisobutylene, triisobutylene, pentene, cyclopentene, hexene, cyclohexane, octene, 1-decene, etc. Also useful are diolefins, for example, butadiene, isoprene, divinyl benzene, pinene, p-menthene and limonene. In general, $C_3$ to $C_6$ olefins or mixtures thereof are preferred and more preferably butylenes are desirable for preparing the sulfurized products embodied herein because the combined sulfur content of the product decreases with increasing carbon content and the miscibility of the product with oil is lower in the case of propylene and ethylene derivatives.

In preparing the sulfurized olefin reactant used in this invention, isobutylene, as noted above, is particularly preferred as the predominant olefinic reactant, but it can be employed, desirably in major proportions, in mixtures containing one or more other olefins; moreover substantial proportions of saturated aliphatic hydrocarbons, as exemplified by methane, ethane, propane, butane, pentane, etc. may be contained in the olefinic feed. Such alkanes are preferably present in minor proportions in most instances to avoid unnecessary dilution of the reaction since they neither react nor remain in the product, but are expelled in the off-gases or by subsequent distillation. However, such mixed feed can substantially improve the economics of the process since such streams are of lower value than a stream of, for example, relatively pure isobutylene.

Volatile olefins are often readily available in liquid form, and it is usually desirable to utilize olefinic liquids which are vaporized by the heat of reaction, as such evaporation provides a substantial cooling effect that permits the flowing of water for cooling the reactor to be reduced considerably for greater economy. Also there are indications that the use of a volatile liquid olefin reactant has the unexpected and desirable effect of lowering the viscosity of the sulfurized olefin reactant.

In accordance with the invention the reaction between the sulfur and the olefinic compound may be conducted in any suitable reaction vessel. The sulfur and olefin are all charged together at ambient temperature into the reaction vessel. The reactor is sealed and the temperature is raised to 160° C.

The specifically narrow molar ratio of sulfur to olefin ranges from about 1.9:1 to about 2.1:1. In the case of butylene, the optimum ratio preferably is from about 1.95:1 to about 2.05:1. The reaction temperature may range from about 140° to about 180° C., preferably from about 158° to 165° C. and most preferably is about 160° C. (159°-161° C.). The reaction pressure is allowed to seek its own optimum level and may range from about 300 to about 900 psi, the preferred pressures are from about 750 to about 850 psi. A critical aspect of the pressure parameter is the pressure at which the reaction is stopped. Once the reaction begins it seeks its own pressure level and is held at a specific temperature most preferably 160° C. until the pressure begins to drop. When this occurs the pressure at the reaction temperature must be allowed to drop to the range of from about 50 to about 100 psi before lowering the temperature and venting the reactor in order to consume all of the olefin charged.

The final pressure is indicative of the cited stoichiometry in accordance with the invention whereby the optimum product, having at least 45-55 wt. % sulfur with no more than about 10-20 wt. % dithiolethione type compounds based upon total weight of the additive product is obtained. If the pressure is higher than about 100 psi when the reactor is vented, not enough olefin has reacted and the product will have poor solubility properties.

Typical reaction time for the reaction range from about 5 to about 10 hours. As noted hereinabove, the narrow range of temperatures, pressures and molar ratios of the reactants are critical. Any deviation outside of above stated ranges produces vastly inferior products. The reaction is carried out in the absence of added $H_2S$.

The reaction between sulfur and olefin can be catalyzed with a rate accelerating catalyst such as, for example, n-butylamine, di-n-butylamine, n-octylamine, triethylamine, di-cyclohexylamine and the like. However, any suitable rate acceleration catalyst known in the art may be used, as for example quinoline and attapulgite acid clay.

The resulting sulfurized olefin is of a different chemical structure than prior art sulfurized olefins. The prior art sulfurized olefins have reactive double bonds and are unsaturated. The sulfurized olefins prepared as disclosed herein consist primarily of dialkyl polysulfides and are fully saturated except for the unreactive aromatic bonds of the 10-20% dithiolethione, i.e., no double bonding is detectable. The dihydrocarbyl phosphates and dihydrocarbyl phosphites thus react in the presence of a suitable catalyst, with the prior art sulfurized olefins through the double bonds still present. When the sulfurized olefins are prepared as described herein the reaction is between the phosphates or phosphites and the reactive sulfur atoms in the sulfurized olefin and requires no catalyst.

The dihydrocarbyl phosphates and phosphites are reacted with sulfurized olefins in the absence of any added catalyst. This is a feature of the invention described herein in that no catalyst is required to conduct the reaction between the special sulfurized olefin used herein and the phosphate or phosphite. As little as 0.01% weight or up to 50% weight and more of dihydrocarbyl phosphate or dihydrocarbyl phosphite, depending upon the amount of reactive sulfur species contained in the sulfurized olefin, can be used in this reaction. It is preferred, however, to use 10-30% weight of dihydrocarbyl phosphate or phosphite. After the reactants have been combined the reaction mixture is stirred until the reaction is completed. The reaction temperature used can be from 0°-150° C. Temperatures of 50°-120° C. are preferred. Solvents can be used to accelerate the reaction. The lower molecular weight alcohols such as isopropanol can be used as reaction solvents. It is generally helpful to exclude air from the reaction system. This can be done with the use of an inert gas purge such as nitrogen. Reaction times can be short or as long as 20 hours depending especially on the reaction temperature. After the reaction is essentially complete, as evidenced by decreases in the concentration of the dihydrocarbyl phosphate or phosphite, the product can be worked up by removal of the solvent. The solvent and dihydrocarbyl phosphate or phosphite can be removed by distillation if volatile. Residual higher molecular weight dihydrocarbyl phosphate or phosphite can be left in the product mixture.

The lubricant compositions hereof may comprise any oleaginous materials that require lubricative properties under extreme pressure conditions and require protection against excessive wear under operating conditions, but normally exhibit insufficient anti-corrosion properties. Especially suitable for use with the additives of this invention are liquid hydrocarbon oils of lubricating viscosity. Lubricant oils, improved in accordance with the present invention, may be of any suitable lubricating viscosity. In general, the lubricant compositions may comprise any mineral or synthetic oil of lubricating viscosity or mixtures thereof. The additives of this invention are especially useful in greases and in automotive fluids such as brake fluids and power brake fluids, transmission fluids, power steering fluids, various hydraulic fluids and gear oils and in liquid hydrocarbyl fuels.

In instances where synthetic oils are desired in preference to refined petroleum or mineral oil they may be employed alone or in combination with a mineral oil. They may also be used as the vehicle or base of grease compositions. Typical synthetic lubricants include polyisobutylene, polybutenes, hydrogenated polydecenes, polypropylene glycol, polyethylene glycol, trimethylol propane esters, neopentyl and pentaerythritol esters of carboxylic acids, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis(p-phenoxy phenyl) ether, phenoxy phenylethers, dialkylbenzenes, etc.

As hereinbefore, indicated, the aforementioned additives can be incorporated as additives in grease compositions. When high temperature stability is not a requirement of the finished grease, mineral oils having a viscosity of at least 40 SSU at 150° F. are useful. Otherwise those falling within the range of from about 60 SSU to about 6,000 SSU at 100° F. may be employed. The lubricating compositions of the improved greases of the present invention, containing the above-described additives, are combined with a grease forming quantity of a thickening agent. For this purpose, a wide variety of materials can be dispersed in the lubricating oil in grease-forming qualities in such degree as to impart to the resulting grease composition the desired consistency. Exemplary of the thickening agents that may be employed in the grease formulation are metal soaps as well as non-soap thickeners, such as surface-modified clays and silicas, aryl ureas, calcium complexes and similar materials. In general, grease thickeners are employed which do not melt or dissolve when used at the required temperature within a particular environment; however, in all other respects, any material which is normally employed for thickening or gelling oleaginous fluids or forming greases may be used in the present invention.

Generally the lubricants and fuels of the present invention contain an amount of the sulfurized product effective to improve extreme pressure properties and antiwear and oxidation characteristics. Normally this amount will be about 0.01–20%, preferably about 0.01–10%, of the total weight of the lubricant.

The invention also contemplates the use of other additives in combination with the sulfurized olefin product. Such additives include, for example, detergents and dispersants of the ash-producing or ashless type, corrosion-inhibiting agents, auxiliary oxidation-inhibiting agents, pour point depression agents, auxiliary extreme pressure agents, color stabilizers and antifoam agents.

The following examples serve to illustrate the present invention, but are not intended as limitations thereon unless otherwise stated.

EXAMPLE 1

Sulfurized Isobutylene

A two-liter stirred autoclave was charged with 320 grams of sulfur. The reactor was sealed and pressurized with nitrogen and vented two times to remove oxygen from the system. The reactor was charged with 280 grams of liquid isobutylene.

The reactor temperature was raised to 160° C. and held at that temperature until the pressure dropped from its maximum of 670 psi, to less than 60 psi. The reactor was cooled to 100° C. and vented to a caustic scrubber. The product was then sparged with nitrogen for three hours at 100° C.

The product was cooled to 50° C. and filtered. The yield was greater than 97% of which 56.6% was sulfur.

EXAMPLE 2

Phosphorylated Sulfurized Isobutylene

The product of Example 1 (88.3 g) was reacted with 11.7 grams of dibutylhydrogen phosphite at 100° C. for one hour. Low boiling material was removed at 15 mm Hg. The product was cooled to 50° C. and filtered. Yield was 98%. The product analyzed 44.2% sulfur and 1.83% phosphorus.

EXAMPLE 3

The procedure of Example 2 was followed using 77 grams of the sulfurized isobutylene product of Example 1 and 23 grams of dibutylhydrogen phosphite. The yield was greater than 98% and the product analyzed 40.0% sulfur and 3.64% phosphorus.

EXAMPLE 4

The procedure of Example 2 was followed using 88 grams of sulfurized isobutylene and 12 grams bis-(2-ethylhexyl)hydrogen phosphite. The yield was greater than 98% and the product analyzed 43.3% sulfur and 1.25% phosphorus.

EXAMPLE 5

Reaction of Sulfurized Isobutylene with Dialkyl Phosphoric Acid

Eighty eight and 3/10 (88.3) grams of the sulfurized isobutylene of Example 1 and 12 grams of di-(2-ethylhexyl) phosphoric acid were reacted at 100° C. for one hour. Low boiling material was removed at 15 mm of mercury. The product was cooled to 50° C. and filtered. The yield was greater than 97% and analyzed 43.7 percent sulfur and 1.19 percent phosphorus.

EXAMPLE 6

The procedure of Example 5 was followed using 77 g sulfurized sulfurized isobutylene and 23 g di-(2-ethylhexyl)phosphoric acid. The yield was greater than 97% and analyzed 39.3% sulfur and 2.24% phosphorus.

The samples prepared in Examples 1–6 were blended into a mineral oil and tested in a Shell Four-Ball Wear Test. The results in the following table clearly show that the phosphorylated sulfurized olefins described herein give improved antiwear protection, when compared to the sulfurized olefin of Example 1.

TABLE 1

SHELL FOUR-BALL WEAR TEST
Four-Ball Wear Test Scar Diameter (mm)
½ Inch Balls, 52011 Steel, 60 kg, 30 Min.

| Additive | Conc. Wt. % | Temp. °F. | Speed (RPM) 1000 | Speed (RPM) 1500 |
|---|---|---|---|---|
| Base Stock | 100 | 200 | 1.45 | 1.8 |
| | | 390 | 1.95 | 2.4 |
| Example 1 | 1 | 200 | 0.9 | 1.25 |
| | | 390 | 1.7 | 1.5 |
| Example 2 | 1 | 200 | 0.6 | 1.0 |
| | | 390 | 1.7 | 1.25 |
| Example 3 | 1 | 200 | 0.55 | 0.55 |
| | | 390 | 1.25 | 1.5 |
| Example 4 | 1 | 200 | 0.5 | 0.7 |
| | | 390 | 1.45 | 1.35 |
| Example 5 | 1 | 200 | 0.9 | 0.85 |
| | | 390 | 1.4 | 1.3 |
| Example 6 | 1 | 200 | 0.6 | 0.75 |
| | | 390 | 1.7 | 1.85 |

EXAMPLE 7

The following tests demonstrate the lack of a reaction when the dialkyl hydrogen phosphites are reacted with prior art sulfurized olefins in the absence of a catalyst.

A. A sample of sulfurized isobutylene prepared by the sulfohalogenation method of Example 1 of U.S. Pat. No. 3,703,504, was reacted according to the procedure described in Example 7 of U.S. Pat. No. 4,207,195, i.e., sulfurized isobutylene was reacted with dibutyl hydrogen phosphite, with the exception that no catalytic agent or catalyst was used. The reaction mixture was agitated at 100° C. to 110° C. for four hours and then at 120° C. to 125° C. for two hours in vacuum.

In a similar procedure 77 grams of sulfurized isobutylene prepared according to the process described herein and in the claims was reacted with 23 grams of dibutyl hydrogen phosphite. No catalyst was added to the reaction mixture. The mixture was heated to 100° C. and held for one hour. It was then cooled to 50° C., vacuum stripped and filtered.

B. In another run 88 grams of the sulfurized isobutylene prepared according to the process described herein was reacted with 12 grams of bis 2-ehtylhexylphosphite and heated for one hour at 100° C. The sample was again cooled, vacuum stripped, and filtered.

Infra red adsorption tests at the 3450, 2410, 1260, and 550 $cm^{-1}$ bands showed that for the procedure in A, no reaction had occurred, i.e., the characterstic bands for dialkyl hydrogen phosphites were still present. For the reactions in B and C the characteristic bands for dialkyl hydrogen phosphites had disappeared indicating that a reaction had taken place.

What is claimed is:

1. A product obtained by reacting the components of a mixture consisting essentially of:

(a) a dihydrocarbyl phosphorus-oxygen compound selected from the group consisting of:

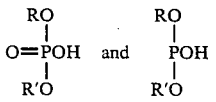

wherein R and R′ are the same or different $C_1$–$C_{30}$ hydrocarbyl groups and (b) a sulfurized olefin containing no reactive olefinic bonds.

2. The product of claim 1 wherein the dihydrocarbyl phosphorus-oxygen compound has the structural formula

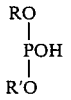

wherein R and R′ are the same or different $C_1$–$C_{30}$ hydrocarbyl groups.

3. The product of claim 1 wherein the dihydrocarbyl phosphorus-oxygen compound has the structural formula

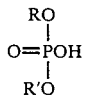

wherein R and R′ are the same or different $C_1$–$C_{30}$ hydrocarbyl groups.

4. The product of claim 1 wherein R and R′ are selected from a $C_1$–$C_{30}$ alkyl or a $C_6$–$C_{30}$ aryl, alkaryl or aralkyl.

5. The product of claim 1 wherein R and R′ are selected from methyl, ethyl, propyl, butyl, pentyl, amyl, hexyl, ethylhexyl, oleyl, phenyl and naphthyl.

6. The product of claim 1 wherein the sulfurized olefin is prepared by reacting in a suitable reaction zone an olefinic hydrocarbyl compound having at least one olefinic double bond with elemental sulfur in a molar ratio of sulfur to olefin of from about 1.9:1 to about 2.1:1 under pressures of from about 300 psi to about 900 psi at temperatures ranging from about 140° to about 180° C. until the reaction pressure drops to about 50 to 100 psi thereby producing a sulfurized additive product containing at least about 45–55 wt. % sulfur and consisting essentially of a major amount of polysulfides and a minor amount of dithiolethione type compounds.

7. The product of claim 1 containing from about 0.01 to about 10% by weight of phosphorus and from about 10 to about 50% by weight of sulfur.

8. The product of claim 1 wherein R and R′ are 2-ethylhexyl.

9. The product of claim 1 wherein R and R′ are butyl.

10. The product of claim 1 wherein the olefin is selected from the group consisting of ethylene, propylene, 1-butene, cis and trans-2-butene, isobutylene, diisobutylene, triisobutylene, pentene, cyclopentene, hexene, cyclohexene, octene, 1-decene, butadiene, isoprene, divinyl benzene, pinene, p-menthene and limonene.

11. The product of claim 1 wherein the olefin is isobutylene.

12. A process for making an additive product suitable for use in oils of lubricating viscosity or greases prepared therefrom or in liquid hydrocarbyl fuels comprising reacting the components of a mixture consisting essentially of:

(a) the product resulting from reacting in a suitable reaction zone until no olefinic bonds are detectable an olefinic hydrocarbyl compound having at least one olefinic double bond with elemental sulfur in a molar ratio of sulfur to olefin of from about 1.9:1 to about 2.1:1 under pressures of from about 300 psi to about 900 psi at temperatures ranging from about 140° to about 180° C. for a time sufficient and until the reaction pressure drops to about 50 to 100 psi thereby producing a sulfurized product containing at least about 45–55 wt. % sulfur and consisting essentially of a major amount of polysulfides and a minor amount of dithiolethione type compounds; and (b) a dihydrocarbyl phosphorus-oxygen compound selected from the group consisting of

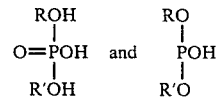

wherein R and R′ are the same or different $C_1$–$C_{30}$ hydrocarbyl groups.

13. The process of claim 12 wherein the dihydrocarbyl phosphorus-oxygen compound has the structural formula

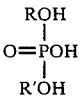

wherein R and R′ are the same or different $C_1$–$C_{30}$ hydrocarbyl groups.

14. The process of claim 12 wherein the dihydrocarbyl phosphorus-oxygen compound has the structural formula

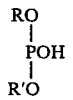

wherein R and R′ are the same or different $C_1$–$C_{30}$ hydrocarbyl groups.

15. The process in accordance with claim 6 wherein the product is prepared in the absence of added $H_2S$.

16. A lubricant composition comprising a major proportion of a hydrocarbon and an antiwear or antioxidant amount of a product obtained by reacting the components of a mixture consisting essentially of:

(a) a dihydrocarbyl phosphorus-oxygen compound selected from the group consisting of:

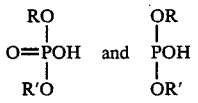

wherein R and R′ are the same or different $C_1$–$C_{30}$ hydrocarbyl groups and (b) a sulfurized olefin containing no reactive olefinic bonds.

17. The composition of claim 16 wherein R and R′ are selected from a $C_1$–$C_{30}$ alkyl or a $C_6$–$C_{30}$ aryl, alkaryl or aralkyl.

18. The composition of claim 16 wherein R and R′ are selected from methyl, ethyl, propyl, butyl, pentyl, amyl, hexyl, ethylhexyl, oleyl, phenyl and naphthyl.

19. The composition of claim 16 wherein the product contains from about 0.01 to about 10% by weight of phosphorus and from about 10 to about 50% by weight of sulfur.

20. The composition of claim 16 wherein R and R′ are 2-ethylhexyl.

21. The composition of claim 16 wherein R and R′ are butyl.

22. The composition of claim 16 wherein the hydrocarbon is a lubricating oil or a grease therefrom.

23. The composition of claim 22 wherein the lubricating oil is a mineral oil.

24. The composition of claim 22 wherein the lubricating oil is a synthetic hydrocarbon fluid.

* * * * *

UNITED STATES PATENT AND TRADEMARK OFFICE

CERTIFICATE OF CORRECTION

PATENT NO. : 4,900,460

DATED : February 13, 1990

INVENTOR(S) : A.B. Cardis

It is certified that error appears in the above-identified patent and that said Letters Patent is hereby corrected as shown below:

| | |
|---|---|
| Col. 1, line 23 | "copounds" should be --compounds-- |
| Col. 7, line 13 | "2-ehtylhexylphosphite"" should be --2-ethylhexylphosphite-- |
| Col. 7, line 11 | delete "B.", insert --C.-- |
| Col. 7, line 18 | "characterstic" should be --characteristic-- |
| Col. 7, line 4 | insert --B.-- before "In" |

Signed and Sealed this

Eleventh Day of December, 1990

*Attest:*

*Attesting Officer*

HARRY F. MANBECK, JR.

*Commissioner of Patents and Trademarks*